US009447351B2

(12) United States Patent
Jung et al.

(10) Patent No.: US 9,447,351 B2
(45) Date of Patent: Sep. 20, 2016

(54) COMPOSITION AND METHOD TO IMPROVE THE FUEL ECONOMY OF HYDROCARBON FUELED INTERNAL COMBUSTION ENGINES

(75) Inventors: Alfred K. Jung, Rockwood, MI (US); Ludwig Voelkel, Limburgerhof (DE); Stefano Crema, Danville, NJ (US); Andrea Misske, Speyer (DE)

(73) Assignee: BASF SE, Ludwigshafen am Rhein (DE)

( * ) Notice: Subject to any disclaimer, the term of this patent is extended or adjusted under 35 U.S.C. 154(b) by 1248 days.

(21) Appl. No.: 12/500,337

(22) Filed: Jul. 9, 2009

(65) Prior Publication Data

US 2010/0006049 A1 Jan. 14, 2010

Related U.S. Application Data

(60) Provisional application No. 61/079,964, filed on Jul. 11, 2008.

(51) Int. Cl.

| | |
|---|---|
| ***C10L 1/22*** | (2006.01) |
| ***C10L 10/00*** | (2006.01) |
| ***C10L 10/08*** | (2006.01) |
| ***C10M 133/02*** | (2006.01) |
| *C10L 1/222* | (2006.01) |
| *C10L 1/224* | (2006.01) |
| *C10L 1/238* | (2006.01) |

(52) U.S. Cl.

CPC ..... *C10L 1/22* (2013.01); *C10L 10/00* (2013.01); *C10L 10/08* (2013.01); *C10M 133/02* (2013.01); *C10L 1/221* (2013.01); *C10L 1/224* (2013.01); *C10L 1/2225* (2013.01); *C10L 1/238* (2013.01); *C10M 2215/042* (2013.01); *C10M 2215/082* (2013.01); *C10N 2230/06* (2013.01); *C10N 2230/54* (2013.01); *C10N 2240/10* (2013.01)

(58) Field of Classification Search

CPC ..... C10L 1/238; C10L 1/1985; C10L 1/2387
USPC ..... 44/399, 603
See application file for complete search history.

(56) References Cited

U.S. PATENT DOCUMENTS

| | | | | |
|---|---|---|---|---|
| 2,252,889 | A | 8/1941 | Haseltine | |
| 3,807,973 | A * | 4/1974 | Iwama et al. | 44/270 |
| 4,185,594 | A | 1/1980 | Perilstein | |
| 4,201,684 | A * | 5/1980 | Malec | 508/328 |
| 4,204,481 | A | 5/1980 | Malec | |
| 4,208,190 | A | 6/1980 | Malec | |
| 4,280,916 | A | 7/1981 | Richards et al. | |
| 4,389,322 | A * | 6/1983 | Horodysky | 508/194 |
| 4,419,255 | A | 12/1983 | Kaufman et al. | |
| 4,427,562 | A | 1/1984 | Horodysky et al. | |
| 4,428,182 | A | 1/1984 | Allen et al. | |
| 4,446,038 | A | 5/1984 | Schlicht et al. | |
| 4,512,903 | A | 4/1985 | Schlicht et al. | |
| 4,525,288 | A | 6/1985 | Schlicht | |
| 4,647,389 | A | 3/1987 | Karol et al. | |
| 4,729,769 | A * | 3/1988 | Schlicht et al. | 44/418 |
| 4,737,160 | A | 4/1988 | Efner | |
| 4,765,918 | A | 8/1988 | Love et al. | |
| 5,028,345 | A * | 7/1991 | Everett et al. | 508/328 |
| 5,229,033 | A | 7/1993 | Nguyen et al. | |
| 5,339,855 | A | 8/1994 | Hellsten et al. | |
| 5,352,374 | A | 10/1994 | Habeeb et al. | |
| 5,523,431 | A * | 6/1996 | Skold | 554/70 |
| 5,719,109 | A | 2/1998 | Tokashiki et al. | |
| 5,891,203 | A * | 4/1999 | Ball et al. | 44/388 |
| 5,979,479 | A | 11/1999 | Hellsten et al. | |
| 6,034,257 | A * | 3/2000 | Oftring et al. | 554/69 |
| 6,277,158 | B1 | 8/2001 | McLean | |
| 6,277,191 | B1 | 8/2001 | Budiansky et al. | |
| 6,524,353 | B2 | 2/2003 | de Rosa et al. | |
| 6,531,443 | B2 | 3/2003 | Perella et al. | |
| 6,534,464 | B1 | 3/2003 | Huish et al. | |
| 6,589,302 | B1 | 7/2003 | DeRosa et al. | |
| 6,689,908 | B1 | 2/2004 | Le Helloco et al. | |
| 6,743,266 | B2 | 6/2004 | DeRosa et al. | |
| 6,746,988 | B2 | 6/2004 | Hopkinson et al. | |
| 6,764,989 | B1 | 7/2004 | Huish et al. | |

(Continued)

FOREIGN PATENT DOCUMENTS

| | | |
|---|---|---|
| DE | 102006006252 A1 | 9/2006 |
| EP | 0586421 | 11/1992 |

(Continued)

OTHER PUBLICATIONS

J.K. Weil, N. Parris, W.R. Noble. F.D. Smth and A.J. Stirton, Tallow alkanolamides: Preparation and Effect on Surfactant Solutions, Nov. 1971, Journal of the American Oil Chemists' Society , vol. 48, vol. 674-677.*

International Search Report and Written Opinion in PCT/US2009/047510 dated Apr. 8, 2009.

Liu, Q. et al., Chemical Abstracts Service, Colombus, Apr. 22, 2008.

English Translation of Japanese Office Action in JP 2011-517451 dated Aug. 28, 2013.

Yamamoto, Kenji; Kotaka, Akihiro; and Umehara, Kazuhiro; Additives for Improving the Fuel Economy of Diesel Engine Systems, Tribology Online, vol. 5, No. 4, 2010, pp. 195-198.

Ushioda, Nobuo and Ogasawara, Yasuhiro; A Study of Fuel Economy Additive Formulation Technology for Passenger Car Motor Oil and Development of a Screener Test for Fuel Economy, Tribology Online, vol. 8, No. 1, 2013, pp. 64-67.

(Continued)

*Primary Examiner* — Ellen McAvoy
*Assistant Examiner* — Ming Cheung Po
(74) *Attorney, Agent, or Firm* — Howard & Howard Attorneys PLLC

(57) ABSTRACT

A composition and method of improving the fuel economy of hydrocarbon fuel-powdered internal combustion engines. The composition contains a propoxylated and/or butoxylated reaction product of (a) at least one fatty acid, fatty acid ester, or mixture thereof and (b) a dialkanolamime. The composition is added to a hydrocarbon fuel in an amount of about 5 to about 2,000 ppm, based on the weight of the hydrocarbon fuel, to reduce friction within the engine and achieve an enhanced fuel economy.

25 Claims, No Drawings

(56) References Cited

U.S. PATENT DOCUMENTS

| | | | |
|---|---|---|---|
| 6,786,939 | B2 | 9/2004 | Hazel et al. |
| 7,645,728 | B2 | 1/2010 | Esche, Jr. et al. |
| 8,425,627 | B2 | 4/2013 | Dietz et al. |
| 2003/0056431 | A1 | 3/2003 | Schwab et al. |
| 2003/0091667 | A1 | 5/2003 | Gormley et al. |
| 2004/0154217 | A1 | 8/2004 | Watanabe et al. |
| 2004/0154218 | A1 | 8/2004 | Watanabe et al. |
| 2004/0231233 | A1 | 11/2004 | Rae et al. |
| 2005/0026805 | A1 | 2/2005 | Queen |
| 2005/0053681 | A1 | 3/2005 | Gormley et al. |
| 2006/0047141 | A1 | 3/2006 | Behler et al. |
| 2006/0196111 | A1 | 9/2006 | Colucci |
| 2006/0254129 | A1 | 11/2006 | Braakman et al. |
| 2010/0006049 | A1 | 1/2010 | Jung et al. |
| 2010/0080767 | A1 | 4/2010 | Queen |
| 2010/0236140 | A1 | 9/2010 | Voelkel et al. |
| 2012/0291737 | A1 | 11/2012 | Mathur et al. |

FOREIGN PATENT DOCUMENTS

| | | | |
|---|---|---|---|
| EP | 0731829 | | 6/1995 |
| EP | 0743354 | A1 | 11/1996 |
| EP | 0936265 | A1 | 8/1999 |
| EP | 1062310 | | 9/1999 |
| EP | 1 785 471 | A1 | 5/2007 |
| EP | 1960500 | | 5/2007 |
| EP | 2082022 | | 5/2008 |
| EP | 2203543 | | 4/2009 |
| EP | 2321389 | | 1/2010 |
| JP | 60-137998 | A | 7/1985 |
| JP | 3879184 | B2 | 1/1999 |
| JP | 2001-505934 | A | 5/2001 |
| JP | 2004-210984 | A | 7/2004 |
| WO | WO-98/16599 | A1 | 4/1998 |
| WO | WO-99/46356 | A1 | 9/1999 |
| WO | WO-2005/113694 | A1 | 12/2005 |
| WO | 2007053787 | A1 | 5/2007 |

OTHER PUBLICATIONS

Tang, Zhenglin and Li, Shaohui; A Review of Recent Developments of Friction Modifiers for Liquid Lubricants (2007-present); Current Opinion in Solid State and Materials Science, vol. 18, 2014, pp. 119-139.

Fujita, H.; Glovnea, R.P. and Spikes, H.A.; Study in Zinc Dialkydithiophosphate Antiwear Film Formation and Removal Processes, Part 1: Experimental, Tribology Transactions, vol. 48, No. 4, 2005, pp. 558-566.

Machine-Generated English Translation of Japanese Patent 3879184B2 obtained from Espacenet on Nov. 3, 2015.

* cited by examiner

COMPOSITION AND METHOD TO IMPROVE THE FUEL ECONOMY OF HYDROCARBON FUELED INTERNAL COMBUSTION ENGINES

CROSS-REFERENCE TO RELATED APPLICATIONS

This application claims the benefit of U.S. provisional patent application 61/079,964, filed Jul. 11, 2008, incorporated in its entirety herein.

FIELD OF THE INVENTION

The present invention is directed to improving the fuel economy of hydrocarbon-fueled internal combustion engines. More particularly, the present invention is directed to an additive composition for hydrocarbon fuels that improves the fuel economy of internal combustion engines. The composition also demonstrates anti-wear properties to reduce engine wear and can act as a friction modifier/anti-wear additive for lubricating oils. The composition is a propoxylated and/or butoxylated reaction product of (a) at least one fatty acid and/or fatty acid ester and (b) a dialkanolamine.

BACKGROUND OF THE INVENTION

Government legislated fuel economy and pollution standards have resulted in efforts by both automotive companies and additive suppliers to enhance the fuel economy of motor vehicles. An additional pressure requiring enhanced fuel economy is the ever rising cost of fuel.

It is well-known that the performance of gasoline and other fuels can be improved through the use of additives. For example, detergents can be added to inhibit the formation of intake system deposits, thereby improving engine cleanliness. More recently, friction modifiers have been added to gasoline to increase fuel economy by reducing engine friction. In selecting suitable components for a detergent or friction modifier additive, it is important to ensure a balance of properties. For example, the friction modifier should not adversely affect the deposit control of the detergent. In addition, the additive package should not exhibit any harmful effects on the performance of the engine, such as valve sticking.

One approach to achieving enhanced fuel economy is to improve the efficiency of the engine in which the fuel is used. Improvement in engine efficiency can be achieved through a number of methods, e.g., improved control over fuel/air ratio, decreased crankcase oil viscosity, and reduced internal friction at specific, strategic areas of an engine.

With respect to reducing friction inside an engine, about 18% of the heat value of fuel is dissipated through internal friction (e.g., bearings, valve train, pistons, rings, water and oil pumps), whereas only about 25% is actually converted to useful work at the crankshaft. The piston rings and part of the valve train account for over 50% of the friction and operate at least part of the time in the boundary lubrication mode during which a friction modifier may be effective. If a friction modifier reduces friction of these components by a third, the friction reduction corresponds to about a 35% improvement in the use of the heat of combustion and is reflected in a corresponding fuel economy improvement. Therefore, investigators continually search for fuel additives that reduce friction at strategic areas of the engine, thereby improving the fuel economy of engines.

Lubricating oil compositions also contain a wide range of additives including those which possess anti-wear properties, anti-friction properties, anti-oxidant properties, and the like. Those skilled in the art of designing lubricating oils therefore are continuously seeking additives that can improve these properties, without a detrimental effect on other desired properties.

Over the years considerable work has been devoted to designing additives that reduce friction in internal combustion engines. For example, U.S. Pat. Nos. 2,252,889, 4,185,594, 4,208,190, 4,204,481, and 4,428,182 disclose additives for diesel engine fuels consisting of fatty acid esters, unsaturated dimerized fatty acids, primary aliphatic amines, fatty acid amides of diethanolamine, and long-chain aliphatic monocarboxylic acids.

U.S. Pat. No. 4,427,562 discloses a friction reducing additive for lubricants and fuels formed by the reaction of primary alkoxyalkylamines with carboxylic acids or alternatively by the ammonolysis of the appropriate formate ester.

U.S. Pat. No. 4,729,769 discloses a detergent additive for gasoline, which contains the reaction product of a $C_6$-$C_{20}$ fatty acid ester, such as coconut oil, and a mono- or di-hydroxyalkylamine, such as diethanolamine or dimethylaminopropylamine.

Other patents disclosing alkanolamides and alkoxylated alkanolamides useful as fuel additives include U.S. Pat. Nos. 4,446,038; 4,512,903; 4,525,288; 4,647,389; 4,765,918; 6,743,266; 6,589,302; 6,524,353; 4,419,255; 6,277,158; 4,737,160; U.S. Pat. Publication No. 2003/0056431; U.S. Pat. Publication No. 2004/0154218; U.S. Pat. Nos. 6,786,939; 6,689,908; U.S. Pat. Publication No. 2006/0047141; U.S. Pat. Nos. 6,034,257; 6,534,464; U.S. Pat. Publication No. 2005/0026805; U.S. Pat. Publication No. 2005/0233929; U.S. Pat. Publication No. 2003/0091667; U.S. Pat. Publication No. 2005/0053681; U.S. Pat. Nos. 6,764,989; 5,979,479; 5,339,855; WO 2005/113694; U.S. Pat. No. 6,746,988; U.S. Pat. Publication No. 2004/0231233; U.S. Pat. No. 6,531,443; WO 99/46356; U.S. Pat. Nos. 6,277,191; and 5,229,033.

However, a need still exists for an improved additive for gasoline and other hydrocarbon-based fuels that provides sufficient friction reduction to enhance fuel economy, that is stable over the temperature range at which the additive is stored, and that does not adversely affect the performance and properties of the finished gasoline or an engine in which the gasoline is used.

SUMMARY OF THE INVENTION

The present invention relates to methods and compositions for improving the fuel economy of hydrocarbon fuels, including gasoline and diesel fuel. More particularly, the present invention relates to a fuel additive for internal combustion engines comprising a propoxylated and/or butoxylated reaction product of (a) one or more fatty acid, one or more fatty acid ester, or mixtures thereof and (b) a dialkanolamine, such as diethanolamine.

More particularly, the present fuel additive comprises a propoxylated and/or butoxylated amide having a formula (I) and an ester compound of formula I(a):

$$R^1—C(=O)—N—[CHR^aCHR^b—O—(CHR^2—CHR^3—O)_nH][CHR^aCHR^b—O—(CHR^2—CHR^3—O)_mH] \quad (I)$$

$$R^1—C(=O)—O—CHR^aCHR^b—N—[CHR^aCHR^bO—(CHR^2CHR^3—O)_q—H][(CHR^2CHR^3—O)_pH], \quad (Ia)$$

wherein $R^1$ is a linear or branched, saturated or unsaturated, $C_7$-$C_{23}$ aliphatic hydrocarbon radical, optionally containing at least one hydroxyl group;

both $R^a$ and $R^b$ are hydrogen or one of $R^a$ and $R^b$ is hydrogen and the other of $R^a$ and $R^b$ is methyl;

—$CHR^2$—$CHR^3$—O, independently, is

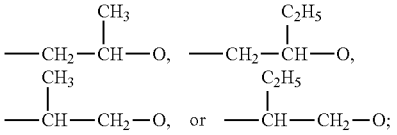

n+m is 0.5 to 5, wherein n and m can be the same or different and one of n and m can be 0; and p+q is 0 to 5, wherein p and q can be the same or different and q alone or both p and q can be 0. In preferred embodiments, p+q is 0 to 3, more preferably p is 0 to 3 and q is 0, and most preferably p is 1 to 3 and q is 0.

In some embodiments, the amide is propoxylated, i.e., one of $R^2$ and $R^3$ is hydrogen and the other is methyl. In other embodiments, the amide is butoxylated, i.e., one of $R^2$ and $R^3$ is hydrogen and the other is ethyl. In still further embodiments, the amide is propoxylated and butoxylated. In preferred embodiments, n+m is 1 to 5, and more preferably 1 to 3.

Another aspect of the present invention is to provide a hydrocarbon fuel comprising a propoxylated and/or butoxylated amide of formula (I) and ester of formula (Ia). The hydrocarbon fuel typically contains about 5 to about 2,000 ppm, by weight, of a compound of formula (I) and/or formula (Ia).

Another aspect of the present invention is to provide a method of improving the fuel economy of an internal combustion engine comprising adding an amide of formula (I) and ester of formula (Ia) to a hydrocarbon fuel, and using the resulting fuel in an internal combustion engine.

Still another aspect of the present invention is to provide an anti-wear additive for a hydrocarbon fuel that reduces engine wear.

Yet another aspect of the present invention is to provide a friction modifier and anti-wear additive for lubricating oils, e.g., crankcase oils.

Another aspect of the present invention is to provide methods of preparing the propoxylated/butoxylated amides of formula (I) and ester of formula (Ia).

These and other novel aspects of the present invention will become apparent from the following detailed description of the preferred embodiments.

DETAILED DESCRIPTION OF THE PREFERRED EMBODIMENTS

The present invention is directed to a fuel additive for addition to a hydrocarbon fuel. The resulting fuel is utilized in an internal combustion engine, resulting in an enhanced fuel economy. As used herein, the term "fuel" or "hydrocarbon fuel" refers to liquid hydrocarbons having boiling points in the range of gasoline and diesel fuel.

To achieve the full advantage of the present invention, the hydrocarbon fuel comprises a mixture of hydrocarbons boiling in the gasoline boiling range. The fuel can contain straight and branched chain paraffins, cycloparaffins, olefins, aromatic hydrocarbons, and mixtures thereof. A hydrocarbon fuel also can contain an alcohol, such as ethanol.

The present invention also is directed to an additive for a lubricating oil to provide anti-wear properties. It is a feature of this invention that a lubricating oil containing an effective amount of a present additives demonstrates anti-wear and anti-friction properties.

The compositions of the present invention can be employed in a variety of lubricants based on diverse oils of lubricating viscosity, including natural and synthetic lubricating oils and mixtures thereof. These lubricants include crankcase lubricating oil for spark-ignited and compression-ignited internal combustion engines, including automobile and truck engines; two cylinder engines; aviation piston engines; marine and railroad diesel engines, and the like. They also can be used in gas engines, stationary power engines, and turbines and the like. Automatic transmission fluids, transaxle fluids, lubricant metal working lubricants, hydraulic fluids, and other lubricating oil and grease compositions also can benefit from the incorporation of an additive of the present invention.

An additive of the present invention is prepared by alkoxylating a mixture of an amide and an ester prepared by reacting (a) at least one fatty acid, at least one fatty acid ester, or a mixture thereof with (b) a dialkanolamide. The amide and ester are alkoxylated with one to five moles of propylene oxide, butylene oxide, or a mixture thereof. The amide and ester are free of alkoxylation with ethylene oxide.

The fuel additive of the present invention comprises an amide compound of formula (I) and an ester compound of formula (Ia):

$$R^1—C(=O)—N—[CHR^aCHR^b—O—(CHR^2—CHR^3—O)_nH][CHR^aCHR^b—O(CHR^2—CHR^3—O)_mH] \quad (I)$$

$$R^1—C(=O)—O—CHR^aCHR^b—N—[CHR^a-CHR^bO—(CHR^2CHR^3—O)_q—H][(CHR^2CHR^3—O)_pH] \quad (Ia)$$

wherein $R^1$ is a linear or branched, saturated or unsaturated, $C_7$-$C_{23}$ hydrocarbon radical, optionally containing at least one hydroxyl group;

both $R^a$ and $R^b$ are hydrogen or one of $R^a$ and $R^b$ is hydrogen and the other of $R^a$ and $R^b$ is methyl;

—$CHR^2$—$CHR^3$—O, independently, is

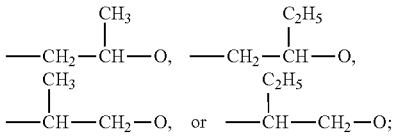

n+m is 0.5 to 5, wherein n and m can be the same or different and one of n and m can be 0; and p+q is 0 to 5, wherein p and q can be the same or different and q alone or both p and q can be 0. In preferred embodiments, p+q is 0 to 3, more preferably p is 0 to 3 and q is 0, and most preferably p is 1 to 3 and q is 0.

More particularly, the present propoxylated/butoxylated amides and esters of structural formula (I) and (Ia) are prepared by first reacting at least one fatty acid and/or at least one fatty acid ester with a dialkanolamine to form a dialkanolamide (II) and ester (IIa). The dialkanolamide and ester then are propoxylated and/or butoxylated with one to five moles of propylene oxide and/or butylene oxide. The dialkanolamide and ester are free of alkoxylation using ethylene oxide. The major product is the amide of formula (I), with the ester of formula (Ia) being present in an amount of up to 30%, and more particularly about 0.1% to about 30%, by total weight of amide (I) and ester (Ia).

Schematically, an alkoxylated amide of structural formula (I) and ester of formula (Ia) are prepared as follows:

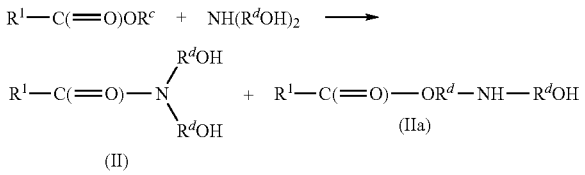

wherein $R^c$ is hydrogen or $C_{1-3}$ alkyl and $R^d$ is an alkylene group containing 2 or 3 carbon atoms. If $R^c$ is $C_{1-3}$alkyl, the $R^cOH$ by-product can remain in the reaction mixture. Optionally, the $R^cOH$ by-product can be removed from the reaction mixture. The amide (II) and ester (IIa) then are alkoxylated with propylene oxide and/or butylene oxide to provide the alkoxylated amide (I) and alkoxylated ester (Ia).

Alternatively, an alkoxylated amide (I) can be prepared from a vegetable oil, animal oil, or triglyceride as follows:

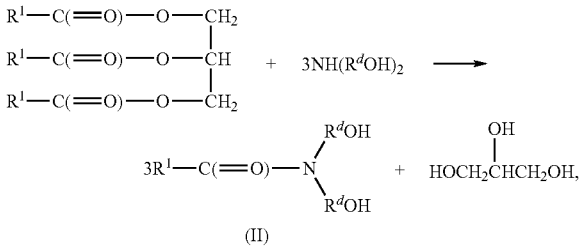

followed by propoxylation/butoxylation preferably in the presence of the glycerin by-product or after separation of compound (II) from the glycerin by-product. In this embodiment, like in the embodiment disclosed above, ester (IIa) and alkoxylated ester (Ia) also are formed.

More particularly, the fatty acid and/or fatty acid ester used in the reaction to form an amide contains 8 to 24 carbon atoms, preferably 8 to 20 carbon atoms, and more preferably 8 to 18 carbon atoms. The fatty acid and/or fatty acid ester therefore can be, but not limited to, lauric acid, myristic acid, palmitic acid, stearic acid, octanoic acid, pelargonic acid, behenic acid, cerotic acid, monotanic acid, lignoceric acid, doeglic acid, erucic acid, linoleic acid, isanic acid, stearodonic acid, arachidonic acid, chypanodoic acid, ricinoleic acid, capric acid, decanoic acid, isostearic acid, gadoleic acid, myristoleic acid, palmitoleic acid, linderic acid, oleic acid, petroselenic acid, esters thereof, and mixtures thereof.

The fatty acid/fatty acid ester also can be derived from a vegetable oil or an animal oil, for example, but not limited to, coconut oil, babassu oil, palm kernel oil, palm oil, olive oil, castor oil, peanut oil, jojoba oil, soy oil, sunflower seed oil, walnut oil, sesame seed oil, rapeseed oil, rape oil, beef tallow, lard, whale blubber, seal oil, dolphin oil, cod liver oil, corn oil, tall oil, cottonseed oil, and mixtures thereof. The vegetable oils contain a mixture of fatty acids. For example, coconut oil typically contains the following fatty acids: caprylic (8%), capric (7%), lauric (48%), myristic (17.5%), palmitic (8.2%), stearic (2%), oleic (6%), and linoleic (2.5%).

The fatty acid component of the amide of formula (II) and ester of formula (IIa) also can be derived from fatty acid esters, such as, for example, glyceryl trilaurate, glyceryl tristearate, glyceryl tripalmitate, glyceryl dilaurate, glyceryl monostearate, ethylene glycol dilaurate, pentaerythritol tetrastearate, pentaerythritol trilaurate, sorbitol monopalmitate, sorbitol pentastearate, propylene glycol monostearate, and mixtures thereof.

The fatty acid component comprises one or more fatty acid per se, one or more fatty acid methyl ester, one or more fatty acid ethyl ester, one or more vegetable oil, one or more animal oil, and mixtures thereof. The amide resulting from the reaction can contain by-products, such as glycerin, ethylene glycol, sorbitol, and other polyhydroxy compounds. The water, methanol, and ethanol by-products from these embodiments are readily removed from the reaction, if desired, to substantially reduce the amount of unwanted by-products. The by-product polyhydroxy compounds do not adversely affect the final propoxylated/butoxylated amide (I) and typically are allowed to remain in the reaction mixture.

A preferred fatty acid/fatty acid ester comprises lauric acid, or a compound having a lauric acid residue, e.g., coconut oil.

The fatty acid and/or fatty acid ester is reacted with a dialkanolamine to provide a dialkanolamide (II). A dialkanolamine contains a hydrogen atom for reaction with the carboxyl or ester group of the fatty acid or fatty acid ester. The dialkanolamine also contains two hydroxy groups for subsequent reaction with propylene oxide and/or butylene oxide. A portion of the dialkanolamine reacts with the fatty acid and/or fatty acid ester to provide ester (IIa) by reaction of a hydroxy group of the dialkanolamine with the fatty acid and/or fatty acid ester. The amino group is available for a subsequent reaction with propylene oxide and/or butylene oxide to form alkoxylated ester (Ia).

Preferred dialkanolamines contain two or three carbons in each of the two alkanol groups. Therefore, preferred dialkanolamines include diethanolamine, di-isopropylamine, and di-n-propylamine. The most preferred dialkanolamine is diethanolamine.

In a preparation of an amide (II) and ester (IIa), the dialkanolamine can be present in an equivalent molar amount to the fatty acid residues in the fatty acid or fatty acid ester. In another embodiment, the dialkanolamine is present in a molar amount different from the moles of fatty acid residues, i.e., a molar excess or deficiency. In a preferred method, the number of moles of dialkanolamine is substantially equivalent to the number of moles of fatty acid residue.

As used herein, the term "fatty acid residue" is defined as $R^1—C(=O)$. Therefore, a methyl ester of a fatty acid, i.e., $R^1—C(=O)OCH_3$, contains one fatty acid residue, and a preferred method utilizes a substantially equivalent number of moles of dialkanolamine to methyl ester. A triglyceride contains three fatty acid residues, and a preferred method utilizes about three moles of dialkanolamine per mole of triglyceride.

Typically, the mole ratio of dialkanolamine to fatty acid residue is about 0.3 to about 1.5, preferably about 0.6 to about 1.3, and more preferably about 0.8 to about 1.2 moles of dialkanolamine per mole of fatty acid residue. To achieve the full advantage of the present invention, the mole ratio of dialkanolamine to fatty acid residue is about 0.9 to about 1.1 moles per mole of fatty acid residue.

The reaction to prepare an amide (II) and ester (IIa) can be performed in the presence or absence of a catalyst. Typically, a basic catalyst is employed. More particularly, a catalyst can be an alkali metal alcoholate, such as sodium methylate, sodium ethylate, potassium methylate, or potassium ethylate. Alkali metal hydroxides, such as sodium or potassium hydroxide acid, and alkali metal carbonates, such as sodium carbonate or potassium carbonate, also can be used as the catalyst.

The amount of catalyst, if present at all, typically is about 0.01% to about 5% by weight, with respect to the amount of amide (II) and ester (IIa) to be produced. The reaction temperature to form an amide (II) and ester (IIa) typically is about 50° C. to about 200° C. The reaction temperature typically is higher than the boiling point of an alcohol, e.g., methanol, and/or water produced during the reaction to eliminate water and/or the alcohol as it is generated in the reaction. Typically, the reaction is performed for about 2 to about 24 hours.

Depending on the starting materials, the final reaction mixture in the preparation of an amide (II) and ester (IIa) typically contains by-products. These by-products can include, for example:

(i) a by-product hydroxy compound, e.g., glycerin or other alcohol;

(ii) a by-product mono-ester of a triglyceride, e.g., glyceryl mono-cocoate;

(iii) a by-product di-ester of a triglyceride, e.g., glyceryl di-cocoate; and (iv) a dialkanolamine, if an excess molar amount of dialkanolamine is employed.

The reaction mixture contains esters (IIa) wherein one or more of the hydroxy groups of the dialkanolamine reacts with the acid, and also can contain ester-amides wherein both ester and amide groups are formed. Preferably, such by-products are allowed to remain in the final reaction mixture containing a propoxylated and/or butoxylated amide of formula (I) and ester of formula (Ia).

After the amide (II) and ester (IIa) are formed, by-products optionally can be separated from the desired amide (II) and ester (IIa). For example, if a vegetable oil is used as the starting material for the fatty acid residues, the glycerin by-product can be removed from the reaction mixture. Typically, the reaction mixture in which an amide (II) and ester (IIa) are formed is used without further purification, except for the removal of solvents and formed water and low molecular weight alcohols, e.g., methanol and ethanol. To avoid the generation of a glycerin by-product, a fatty acid or a fatty acid methyl ester can be used as the fatty acid residue source.

After formation of an amide (II) and ester (IIa), a mole of the amide and ester (in total) is reacted with one to five total moles, and preferably one to three total moles, of propylene oxide and/or butylene oxide. In accordance with the present invention, an amide (II) and ester (IIa) are not alkoxylated with ethylene oxide. In this step, an amide (II) and ester (IIa) can be propoxylated first, then butoxylated; or butoxylated first, then propoxylated; or propoxylated and butoxylated simultaneously. An amide (II) and ester (IIa) also can be solely propoxylated or solely butoxylated. Preferably, one mole of an amide (II) and ester (IIa), in total, is solely propoxylated with about 1 to about 3 moles of propylene oxide.

The propoxylation/butoxylation reaction often is performed under basic conditions, for example by employing a basic catalyst of the type used in the preparation of an amide (II) and ester (IIa). Additional basic catalysts are nitrogen-containing catalysts, for example, an imidazole, N—N-dimethylethanolamine, and N,N-dimethylbenzylamine. It also is possible to perform the alkoxylation reaction in the presence of a Lewis acid, such as titanium trichloride or boron trifluoride. The amount of catalyst utilized is about 0.5% to about 0.7%, by weight, based on the amount of amide (II) and ester (IIa), in total, used in the alkoxylation reaction. In some embodiments, a catalyst is omitted.

The temperature of the alkoxylation reaction typically is about 80° C. and about 180° C. Preferably, the alkoxylation reaction is performed an atmosphere that is inert under the reaction conditions, e.g., nitrogen.

The alkoxylation reaction also can be performed in the presence of a solvent. The solvent is inert under the reaction conditions. Suitable solvents are aromatic or aliphatic hydrocarbon solvents, such as hexane, toluene, and xylene. Halogenated solvents, such as chloroform, or ether solvents, such as dibutyl ether and tetrahydrofuran, also can be used.

In preferred embodiments, the reaction mixture that yields a dialkanolamide (II) and ester (IIa) is used without purification in the alkoxylation reaction to provide an alkoxylated amide (I) and alkoxylated ester (Ia). In another preferred embodiment, the reaction mixture that provides an alkoxylated amide (I) and ester (Ia) also is used without purification. As a result, a preferred reaction product of the present invention comprises a variety of products including, for example, alkoxylated amide (I), alkoxylated ester (Ia), dialkanolamide (II), ester (IIa), unreacted dialkanolamine, by-product hydroxy compounds (e.g., glycerin or other alcohol), mono- and/or di-esters of a starting triglyceride, polyalkylene oxide oligomers, aminoesters, and ester-amides.

It also should be understood that the proxylation/butoxylation reaction yields a mixture of alkoxylated amides (I) and alkoxylated esters (Ia). In particular, both $CH_2CH_2OH$ groups of the dialkanolamide (II) can be alkoxylated, either to a different degree (i.e., $n>0$, $m>0$, and $n\neq m$) or to the same degree (i.e., $n>0$, $m>0$, and $n=m$). In preferred embodiments, only one $CH_2CH_2OH$ of the dialkanolamide (II) is alkoxylated (i.e., one of n or m is 0). In most preferred embodiments, a dialkanolamide is alkoxylated with one mole of alkylene oxide, and preferably one mole of propylene oxide. It is envisioned that a portion of the dialkanolamide (II) will not be alkoxylated, thus $n+m$ can be less than 1, i.e., a lower limit of 0.5.

The following are examples of the present alkoxylated amides of formula (I) and alkoxylated esters of formula (Ia).

EXAMPLE 1

A. Condensation to Form a Coconut Oil Diethanolamide Composition

Coconut oil (3.80 kg, 5.78 mol) was added to a reactor and heated to about 130° C. Diethanolamine (DEA) (1.22 kg, 11.6 mol, 2 eq.) was added, and the resulting mixture was maintained at a reaction temperature of about 130° C., with stirring, for an additional 6 hours. Progress of the reaction was monitored by amine number. The product was a viscous yellow to brown oil (5.01 kg), which was used in the alkoxylation reaction without purification.

The condensation reaction was performed using the following starting materials.

| | |
|---|---|
| Coconut oil | 40-50% $C_{12}$<br>15-20% $C_{14}$<br>7-12% $C_{16}$ |
| Diethanolamine | >99% purity |

The molecular weight of the coconut oil was calculated from the saponification value.

B. Amine Catalyzed Alkoxylation

The diethanolamide reaction product of step A (869 g, 2.02 mol) was admixed with an amine catalyst (4.9 g N,N-dimethylethanolamine, 0.06 mol, 0.5 w/w %). The resulting mixture was heated to about 110° C. Propylene oxide (117 g, 2.02 mol, 1.0 eq) was added, and the mixture was stirred for additional 12 hours at the reaction temperature. Unreacted propylene oxide was removed under reduced pressure and/or by flushing with nitrogen gas to yield the reaction product.

The following Scheme illustrates the reactions of steps A and B, and the reaction products present after step B.

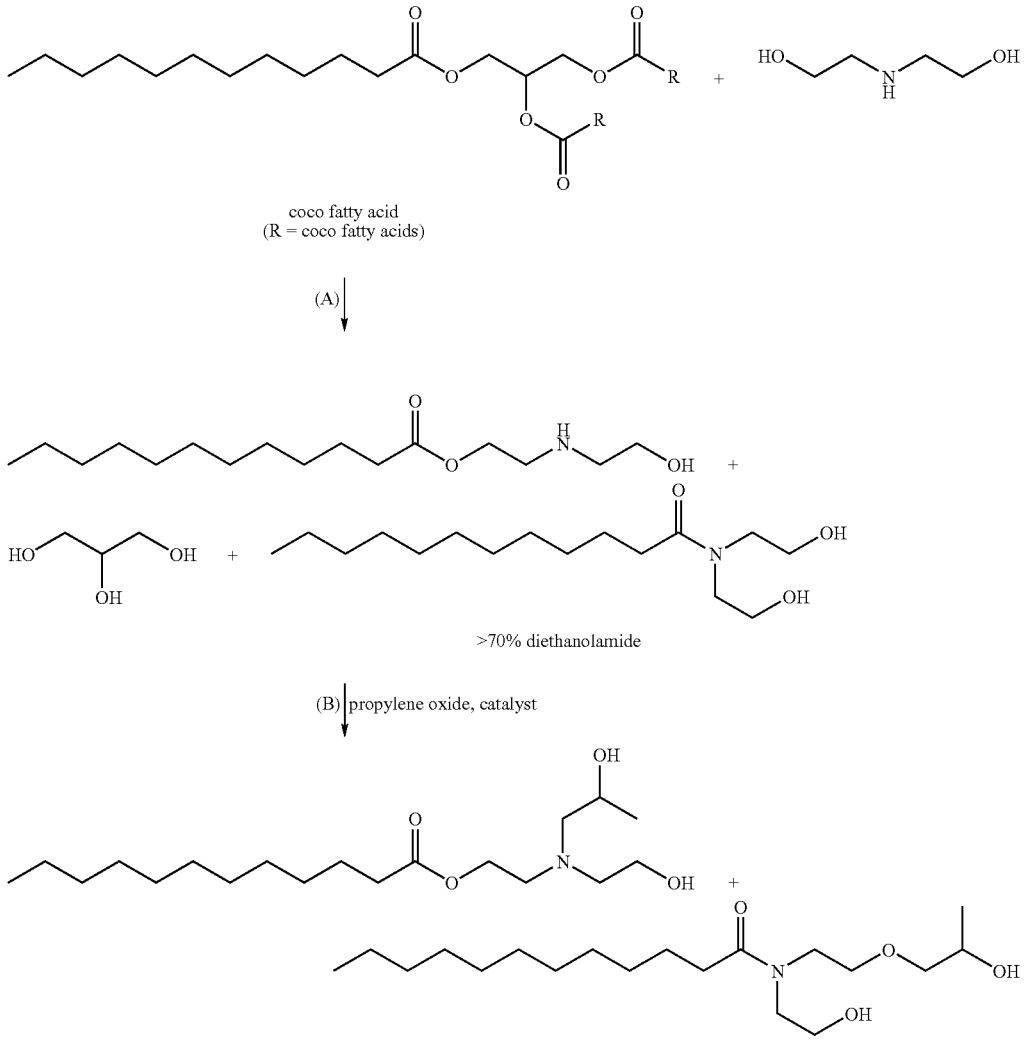

It is noted that an ester also forms in step A, together with the diethanolamide. This ester and unreacted diethanolamine are present during the alkoxylation step B, and typically are allowed to remain in the final product. As noted in the above reaction scheme, the ester of step A also was propoxylated. It is further noted that the above Scheme only depicts the main reaction products. The degree of propoxylation is subject to statistic distribution, and further reaction products in minor amounts such as various ethers and heterocycles, e.g., bishydroxyethylpiperazine, as well as residual unreacted compounds, can be found.

EXAMPLE 2

A. Condensation to Form a Coconut Fatty Acid Diethanolamide Composition

Coconut fatty acid (3.05 kg, 14.4 mol) was placed in a reactor and heated to about 80° C. Diethanolamine (1.52 kg, 14.4 mol, 1.0 eq.) was added, and the resulting mixture was heated to reaction temperature of about 150° C., then stirred for additional 8 hours. Progress of the reaction was monitored by acid number, amine number, and the amount of distillate. The product was a viscous yellow to brown oil (3.95 kg), which was used in the alkoxylation reaction without further purification.

The combination reaction was performed using the following starting materials.

| | Trade Name | Spec. |
|---|---|---|
| Coconut fatty acid | EDENOR K8-18 | 45-53% $C_{12}$<br>17-21% $C_{14}$<br>7-13% $C_{16}$ |
| Diethanolamine | | >99% purity |

The molecular weight of the coconut fatty acid was calculated from the acid number.

B. Amine Catalyzed Alkoxylation

The diethanolamide reaction product of step A (495 g, 1.72 mol) was admixed with an amine catalyst (3.0 g N,N-dimethylethanolamine, 0.03 mol, 0.5 w/w %). The resulting mixture was heated to about 115° C. Propylene oxide (100 g, 1.72 mol, 1.0 eq) was added and the mixture was stirred for additional 12 hours at about 115° C. Unreacted propylene oxide was removed under reduced pressure and/or by flushing with nitrogen to yield the reaction product.

The following scheme illustrates the reactions of steps A and B, and the reaction products present after step B.

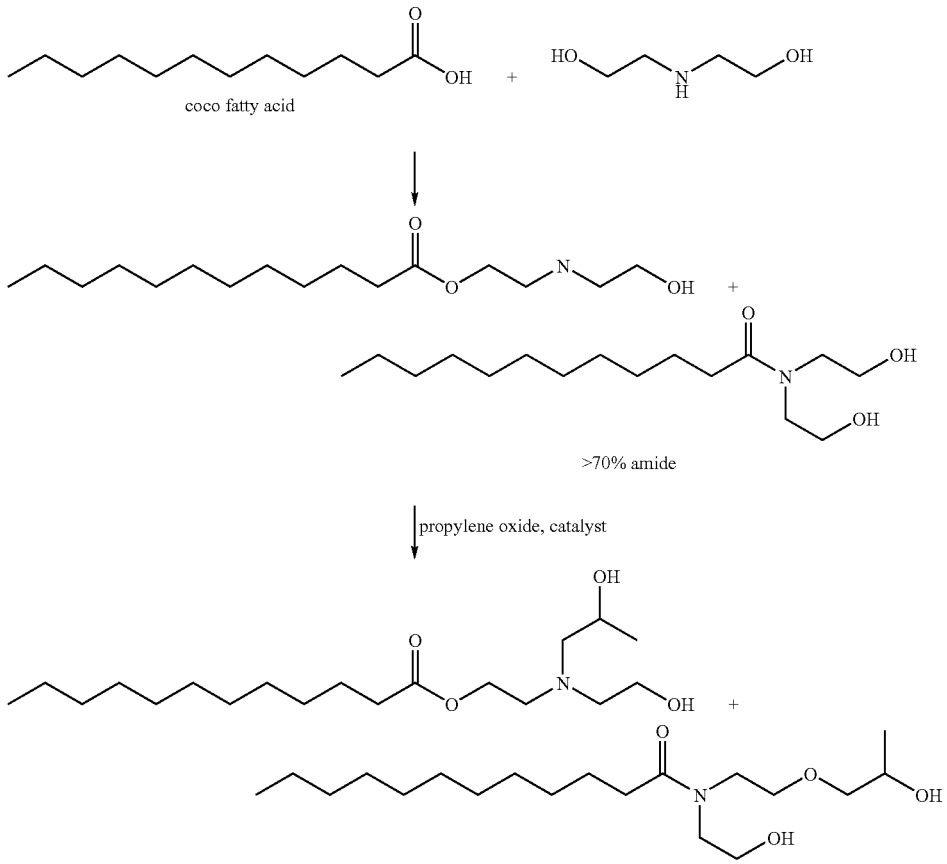

An ester also is formed in step A, together with the diethanolamide. This ester and any unreacted diethanolamine are present during the alkoxylation step B, and typically are allowed to remain in the final product. As noted in the above reaction scheme, the ester of step A also was propoxylated. It is further noted that the above Scheme only depicts the main reaction products. The degree of propoxylation is subject to statistic distribution, and further reaction products in minor amounts such as various ethers and heterocycles, e.g., bishydroxyethylpiperazine, as well as residual unreacted compounds, can be found.

A composition comprising a propoxylated/butoxylated amide (I) and ester (Ia) of the present invention is added to a hydrocarbon fuel, e.g., gasoline or diesel fuel, or a lubricating oil, in an amount of about 5 to about 2000 ppm, preferably about 10 to about 1500 ppm, more preferably about 50 to about 1250 ppm, by weight of the fuel. To achieve the full benefit of the present invention, a propoxylated/butoxylated amide (I) is added to a hydrocarbon fuel or a lubricating oil in an amount of about 100 to about 1000 ppm, by weight, of the fuel.

On a commercial scale, a present propoxylated/butoxylated amide (I) is added to a hydrocarbon fuel in an amount of about 5 to about 250 PTB (pounds per thousand barrels), preferably about 20 to about 200 PTB, more preferably about 40 to about 175 PTB, by weight. To achieve the full advantage of the present invention, a composition comprising a propoxylated/butoxylated amide (I) and ester (Ia) is added to a fuel in an amount of about 50 to about 150 PTB, by weight.

A hydrocarbon fuel containing a present propoxylated/butoxylated amide (I) and ester (Ia) improves the fuel economy of an engine. A present propoxylated/butoxylated amide (I) and ester (Ia) also exhibit improved low temperature handling properties over prior antifriction gasoline additives. A composition comprising a present alkoxylated amide (I) and ester (Ia) reduces engine wear by acting as an anti-wear additive for a hydrocarbon fuel. In addition, a present composition comprising an alkoxylated amide (I) and ester (Ia) can be used as a friction modifier and anti-wear additive for lubricating and similar oils, such as crank case oils.

The present invention therefore provides a method of operating an internal combustion engine wherein a vehicle equipped with an internal combustion engine is operated with a fuel containing a propoxylated/butoxylated amide (I)

and ester (Ia). The method improves the fuel economy of the vehicle attributed to the friction reductions provided by the propoxylated/butoxylated amide (I) and ester (Ia).

To demonstrate the new and unexpected benefits of the present invention, the following fuel economy test was prepared. In particular, a propoxylated amide (I) and ester (Ia) of the present invention was prepared from a reaction product of coconut oil and diethanolamine propoxylated with one mole of propylene oxide, e.g., Example 1. The reaction product of coconut oil and diethanolamine was used in the propoxylation reaction without purification. This propoxylated amide (I) and ester (Ia) was added to a commercial British Petroleum fuel, i.e., gasoline, in an amount of 100 PTB (or alternatively 380 ppm).

The resulting fuel was used in fourteen different automobiles for an average of about 10.25 miles (16.5 kilometers). Fuel economy tests were performed using the Environmental Protection Agency test protocol, C.F.R. Title 40, Part 600, Subpart B, which is well-known in the art. The measured fuel economy for each automobile was compared to the fuel economy for the same automobile in the absence of the propoxylated amide (1) and ester (Ia) in the fuel. At a 95% confidence limit, the fuel economy for those representative vehicles was improved by an average of 2.92% over all the automobile tested. The following table summarizes the results of the above fuel economy test for each automobile.

| Automobile (Year) | Engine/ Displacement | % Fuel Economy |
|---|---|---|
| Pontiac Grand Am (2006) | 3.8L/6 | NA (not available) |
| Dodge Neon (2005) | 2.0L/4 | 3.61 |
| Chevrolet Classic (2005) | 2.2L/4 | 1.65 |
| Ford Freestar (2006) | 3.9L/6 | 2.80 |
| Chevrolet Impala (2006) | 3.5L/6 | NA |
| Mazda 3 (2006) | 2.3L/DOHC | 1.52 |
| Buick LaCrosse (2006) | 3.9L/6 | 2.81 |
| Toyota Sienna (2006) | 3.3L/6 | NA |
| Chrysler 300 (2006) | 2.7L/6 | 3.14 |
| Toyota Camry (2006) | 2.4L/DOHC | 4.57 |
| Pontiac Grand Prix (2006) | 3.8L/6 | 2.26 |
| Buick LaCrosse (2006) | 3.8L/6 | NA |
| Cadillac CTS (2006) | 2.8L/6 | 5.1 |
| Mazda 3 (2006) | 2.0L/4 | 1.8 |

The invention claimed is:

1. A composition comprising (i) an alkoxylated amide having a structure:

$R^1$—C(═O)—N—[$CHR^aCHR^b$—O—($CH(CH_3)$—$CH_2$—O)$_n$H][$CHR^aCHR^b$—O—($CH(CH_3)$—$CH_2$—O)$_m$H], and (ii) an alkoxylated ester having a structure:

$R^1$—C(═O)—O—$CHR^aCHR^b$—N—[($CHR^a$-$CHR^bO$)—($CH(CH_3)$—$CH_2$—O)$_q$—H][($CH(CH_3)$—$CH_2$—O)$_p$H]

wherein $R^1$ is a linear or branched, saturated or unsaturated, $C_7$-$C_{23}$ aliphatic hydrocarbon radical, optionally containing at least one hydroxyl group;

both $R^a$ and $R^b$ are hydrogen or one of $R^a$ and $R^b$ is hydrogen and the other of $R^a$ and $R^b$ is methyl;

n+m is 0.5 to 5, wherein n and m can be the same or different and one of n and m can be 0; and p+q is 1 to 5, wherein p and q can be the same or different and q can be 0, and wherein the alkoxylated ester is present in the composition in an amount of up to about 30 weight parts per 100 weight parts of the total alkoxylated amide and alkoxylated ester.

2. The composition of claim 1 wherein $R^1$—C(═O)— is a residue of a fatty acid, a fatty acid ester, a vegetable oil, an animal oil, or mixtures thereof.

3. The composition of claim 2 wherein $R^1$—C(═O)— contains 8 to 24 carbon atoms.

4. The composition of claim 2 wherein the fatty acid is selected from the group consisting of lauric acid, myristic acid, palmitic acid, stearic acid, octanoic acid, pelargonic acid, behenic acid, cerotic acid, monotanic acid, lignoceric acid, doeglic acid, erucic acid, linoleic acid, isanic acid, stearodonic acid, arachidonic acid, chypanodoic acid, ricinoleic acid, capric acid, decanoic acid, isostearic acid, gadoleic acid, myristoleic acid, palmitoleic acid, linderic acid, oleic acid, petroselenic acid, esters thereof, and mixtures thereof.

5. The composition of claim 2 wherein the fatty acid is a methyl ester or an ethyl ester of a fatty acid selected from the group consisting of a lauric acid, myristic acid, palmitic acid, stearic acid, octanoic acid, pelargonic acid, behenic acid, cerotic acid, monotanic acid, lignoceric acid, doeglic acid, erucic acid, linoleic acid, isanic acid, stearodonic acid, arachidonic acid, chypanodoic acid, ricinoleic acid, capric acid, decanoic acid, isostearic acid, gadoleic acid, myristoleic acid, palmitoleic acid, linderic acid, oleic acid, petroselenic acid, esters thereof, and mixtures thereof.

6. The composition of claim 2 wherein the vegetable oil or animal oil is selected from the group consisting of a coconut oil, babassu oil, palm kernel oil, palm oil, olive oil, castor oil, peanut oil, jojoba oil, soy oil, sunflower seed oil, walnut oil, sesame seed oil, rapeseed oil, rope oil, beef tallow, lard, whale blubber, seal oil, dolphin oil, cod liver oil, corn oil, tall oil, cottonseed oil, and mixtures thereof.

7. The composition of claim 2 wherein the fatty acid ester is selected from the group consisting of glyceryl tristearate, glyceryl tripalmitate, glyceryl dilaurate, glyceryl monostearate, ethylene glycol dilaurate, pentaerythritol tetrastearate, pentaerythritol trilaurate, sorbitol monopalmitate, sorbitol pentastearate, propylene glycol monostearate, and mixtures thereof.

8. The composition of claim 1 wherein $R^1$—C(═O)— is a residue of coconut oil fatty acids.

9. The composition of claim 1 wherein $CHR^a$—$CHR^b$—O— is $CH_2$—$CH_2$—O—.

10. The composition of claim 1 wherein n+m is 1 to 5.

11. The composition of claim 1 wherein n+m is 1 to 3.

12. The composition of claim 1 wherein one of n and m is 0.

13. The composition of claim 1 wherein p+q is 1 to 3.

14. A fuel composition comprising:

(a) a major amount of a hydrocarbon fuel for an internal combustion engine; and (b) a minor amount of a composition of claim 1.

15. The fuel composition of claim 14 wherein the fuel composition comprises about 50 to about 2000 ppm, by weight, of the composition of claim 1.

16. The fuel composition of claim 14 wherein the fuel composition comprises about 20 to about 250 pounds per thousand barrels of the composition of claim 1.

17. The fuel composition of claim 14 wherein the hydrocarbon fuel is a gasoline or a diesel fuel.

18. A method of operating an internal combustion engine comprising operating the engine employing a fuel composition comprising:

(a) a major amount of a hydrocarbon fuel for an internal combustion engine; and (b) a minor amount of a composition of claim 1.

19. A method of reducing friction in the operation of an internal combustion engine comprising fueling the engine with a fuel composition comprising:

(a) a major amount of a hydrocarbon fuel for an internal combustion engine; and (b) a minor amount of a composition of claim 1.

20. A method of reducing friction and engine wear in operation of an internal combustion engine comprising employing a lubricating oil composition comprising (a) a major amount of a lubricating oil for an internal combustion engine; and (b) a minor amount of a composition of claim 1.

21. A composition comprising reaction products prepared by:

(a) reacting a fatty acid, a fatty acid ester, a vegetable oil, an animal oil, or mixtures thereof with a dialkanolamine in an amount of about 0.3 to about 1.2 moles of the dialkanolamine per mole of fatty acid residue to form a first reaction product comprising a dialkanolamide of the fatty acid residues, then (b) subjecting the first reaction product of (a) to a propoxylation reaction, in the absence of ethylene oxide, with one to five total moles of propylene oxide per mole of dialkanolamide in the first reaction product of (a), wherein the composition comprises one or more alkoxylated amides having a structure:

$R^1—C(=O)—N—[CHR^aCHR^b—O—(CH(CH_3)—CH_2—O)_nH][CHR^aCHR^b—O—(CH(CH_3)—CH_2—O)_mH]$, and one or more alkoxylated esters having a structure:

$R^1—C(=O)—O—[CHR^aCHR^b—N—(CHR^a—CHR^bO)—(CH(CH_3)—CH_2—O)_q—H][(CH(CH_3)—CH_2—O)_pH]$ wherein $R^1$ is a linear or branched, saturated or unsaturated, $C_7$-$C_{23}$ aliphatic hydrocarbon radical, optionally containing at least one hydroxyl group;

both $R^a$ and $R^b$ are hydrogen or one of $R^a$ and $R^b$ is hydrogen and the other of $R^a$ and $R^b$ is methyl;

n+m is 0.5 to 5, wherein n and m can be the same or different and one of n and m can be 0; and p+q is 1 to 5, wherein p and q can be the same or different and q can be 0, and wherein the alkoxylated ester is present in the composition in an amount of up to about 30 weight parts per 100 weight parts of the total alkoxylated amide and alkoxylated ester.

22. The composition of claim 21 further comprising one or more of the dialkanolamine, glycerin, the fatty acid, the fatty acid residue, a vegetable oil, and an animal oil.

23. The composition of claim 21 wherein the vegetable oil comprises coconut oil.

24. The composition of claim 21 wherein the dialkanolamine comprises diethanolamine.

25. A lubricant composition comprising:

A. a lubricating oil; and

B. an additive comprising;

(i) an alkoxylated amide having a structure:

$R^1—C(=O)—N—[CHR^aCHR^b—O—(CH(CH_3)—CH_2—O)_nH][CHR^aCHR^b—O—(CH(CH_3)—CH_2—O)_mH]$, and (ii) an alkoxylated ester having a structure:

$R^1—C(=O)—O—CHR^aCHR^b—N—[(CHR^a—CHR^bO—)—(CH(CH_3)—CH_2—O)_q—H][(CH(CH_3)—CH_2—O)_pH]$ wherein $R^1$ is a linear or branched, saturated or unsaturated, $C_7$-$C_{23}$ aliphatic hydrocarbon radical, optionally containing at least one hydroxyl group;

both $R^a$ and $R^b$ are hydrogen or one of $R^a$ and $R^b$ is hydrogen and the other of $R^a$ and $R^b$ is methyl;

n+m is 0.5 to 5, wherein n and m can be the same or different and one of n and m can be 0; and p+q is 1 to 5, wherein p and q can be the same or different and q can be 0, and wherein the alkoxylated ester is present in the composition in an amount of up to about 30 weight parts per 100 weight parts of the total alkoxylated amide and alkoxylated ester.

* * * * *